United States Patent [19]

Hanner et al.

[11] Patent Number: 4,734,741

[45] Date of Patent: Mar. 29, 1988

[54] PARTICULATE MATERIAL CLEANING APPARATUS

[75] Inventors: Paul M. Hanner, Rochester; Gary B. Bertram, Honeoye Falls, both of N.Y.

[73] Assignee: Eastman Kodak Company, Rochester, N.Y.

[21] Appl. No.: 85,664

[22] Filed: Aug. 13, 1987

[51] Int. Cl.[4] ..... G03G 21/00

[52] U.S. Cl. ..... 355/15; 15/1.5 R; 15/256.52; 15/256.5; 118/652

[58] Field of Search ..... 355/15; 118/652; 15/1.5 R, 256.5, 256.51, 256.52

[56] References Cited

U.S. PATENT DOCUMENTS

| | | | |
|---|---|---|---|
| 3,879,124 | 4/1975 | Eppe et al. | 355/15 |
| 3,909,864 | 11/1975 | Tanaka et al. | 355/15 X |
| 3,955,235 | 5/1976 | Meyer | 355/15 X |
| 3,982,043 | 9/1976 | Simpson | 355/15 X |
| 4,123,154 | 10/1978 | Fisher | 15/256.52 X |
| 4,251,155 | 2/1981 | Schnall et al. | 355/15 |
| 4,278,345 | 7/1981 | Davis et al. | 355/15 |

*Primary Examiner*—A. T. Grimley
*Assistant Examiner*—Jane K. Lau
*Attorney, Agent, or Firm*—Leonard W. Treash

[57] ABSTRACT

A toner cleaning apparatus using particulate cleaning material includes a particulate cleaning material replacement device which receives a container of fresh cleaning material. The container is inverted by the device and material is metered onto a brush in response to normal operation of the apparatus. Old material is automatically stripped off the brush in the replacement process. New material cannot be added without removing old material, thereby preventing overloading of the brush. A movable skive stripping member is also disclosed to automatically remove old particulate material from the brush when new particulate material is added.

20 Claims, 2 Drawing Figures

PARTICULATE MATERIAL CLEANING APPARATUS

TECHNICAL FIELD

This invention relates to apparatus for cleaning toner off a moving surface, and more particularly to such apparatus in which particulate cleaning material is brushed across the moving surface.

BACKGROUND ART

Electrophotographic copiers, printers and the like, using a dry toning and transfer process generally require a cleaning apparatus to remove residual toner from a moving surface after the transfer step. U.S. Pat. Nos. 3,580,673; 4,006,987; 4,110,034; 4,279,499; and 4,515,467 describe examples of cleaning apparatus in which particulate material which is triboelectrically attractive to toner is brushed across the moving surface to clean it. Toner attracted to the particulate material is removed from the particulate material at a location remote from the moving surface and the particulate material recirculated past the moving surface again to pick up more toner.

In time, the toner creates a scum on the particulate material, it loses its cleaning ability, and must be replaced. U.S. Pat. No. 4,279,499 shows a magnetic brush cleaning device having a sump for particulate magnetic cleaning material and a skive which can be used to remove the cleaning material to permit the addition of new material. U.S. Pat. No. 4,515,467 shows the metering of cleaning material from a hopper as required by the apparatus.

In all such prior apparatus the cleaning material replacement operation is done by a serviceman because of the likelihood of contact with toner, because the cleaning material must be handled in bulk and because of the complexity of the replacement operation.

DISCLOSURE OF THE INVENTION

It is the object of the invention to provide cleaning apparatus generally of the type using a particulate cleaning material which apparatus facilitates replacement of the cleaning material by a person less skilled than required by the prior art.

This and other objects are accomplished by a particulate cleaning material replacement device for a cleaning apparatus of the type described which device includes means for receiving a container containing particulate cleaning material which container has an opening. The container receiving means is rotatable between a first position in which the container opening is generally up and a second position in which said opening is in metering relation with the cleaning apparatus. Means for rotating the container receiving means from its first position to its second position is actuable in response to operation of the apparatus.

According to a preferred embodiment, the replacement device is part of a cleaning apparatus which includes a magnetic brush for moving cleaning material through an endless path, which path includes cleaning relation with a toner bearing moving surface. The brush in moving through this path cooperates with a restricted passageway between the container opening and the brush to meter the contents of the container onto the brush.

According to another preferred embodiment, the container receiving means is also movable from its second position to its first position, for example, by hand. A skive is movable into stripping relation with the brush in response to this rotation. When the container receiving means is in its first position, an empty container can be removed and a full one inserted and the apparatus turned on or cycled. The container receiving means is then rotatable to its second position. In response to this rotation, the skive first strips particulate material off the brush and then moves to a nonstripping position.

According to another preferred embodiment of the invention, a detent prevents removal or insertion of a container except when the container receiving means is in its first position.

According to another preferred embodiment of the invention, the apparatus includes a movable detoning means which includes means for driving the rotational movement of the container receiving means from its first position to its second position.

This apparatus permits replacement of cleaning material by a relatively unskilled operator. The removal of the old carrier is automatically accomplished in the process of inserting the container having new material. The new material is metered onto the brush as the brush moves through its normal cycle.

BEST MODE OF CARRYING OUT THE INVENTION

Figure 1:
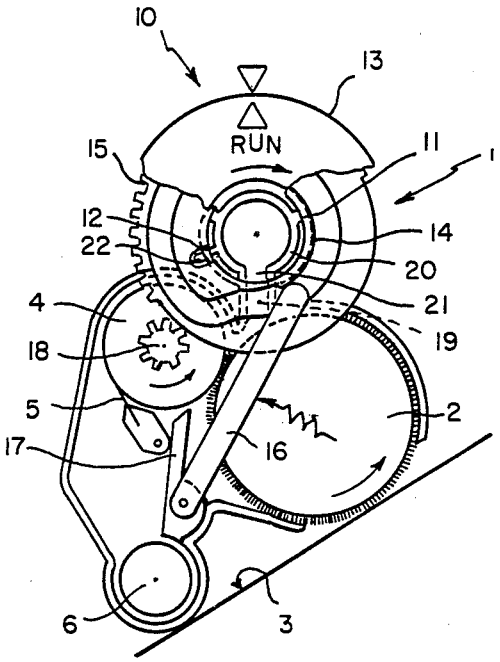
FIGS. 1 and 2 are side schematic views of a cleaning apparatus constructed according to the invention illustrating "run" and "service" conditions, respectively.
Figure 2:
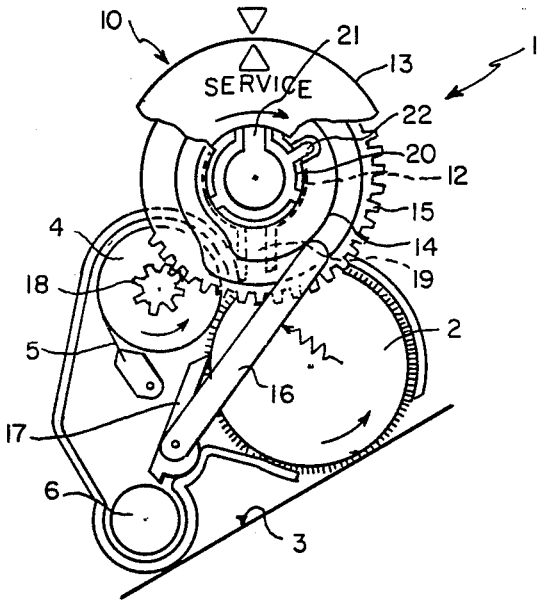

According to FIGS. 1 and 2, a magnetic brush cleaning apparatus 1 includes a magnetic brush 2 which is driven by means not shown to transport magnetic particulate cleaning material through an endless path which includes cleaning relation with a moving surface 3. The magnetic brush may be in the form of a belt or, as shown in the Figs., a roller which rotates around stationary magnets, as is well known in the cleaning and toning art. It may also comprise a stationary or rotating shell around rotating magnets, as is well known in the toning art.

The particulate cleaning material brushes the moving surface, preferably in a direction opposite to the direction of movement of the surface, picking up residual toner by triboelectric attraction. The residual toner is transported past a detoning means, for example a detoning roller 4, which is electrically biased to attract toner from the brush and which may be driven by a drive means common with that for the brush 2. Toner is cleaned off detoning roller 4 by a cleaning blade 5 and falls into a removal zone or sump where it is removed by an auger 6. As the brush 2 continues to rotate, the particular material, now starved of toner, is returned to the moving surface 3 to continue the cleaning process.

Because of scumming and other aspects of use, the cleaning material must be periodically replaced. A particulate cleaning material replacement device 10 forms part of the cleaning apparatus to accomplish this function in a simple and convenient manner. More specifically, a container receiving means 11 is located generally above the brush 2. A cylindrically shaped container 20 is receivable in container receiving means 11. Container receiving means 11 is rotatable through 360 degrees and specifically between a first position, as shown in FIG. 2, and a second position, as shown in FIG. 1.

Container 20 has an opening 21 running longitudinally the length of the container and a tab 22. A detent 12 associated with container receiving means 11 prevents insertion or removal of a container except when the receiving means 11 is in its first position as shown in FIG. 2. When the container receiving means 11 is in its second position, longitudinal opening 21 mates with a restricted passageway 19 between the opening 21 and the brush 2.

A knob 13, a cam 14 and a driven gear 15, having teeth around approximately 180 degrees of its periphery, are all rotatable with container receiving means 11. A lever 16 follows cam 14 and controls a stripping skive 17. A drive gear 18 is rotatable with detoning roller 4 and drives driven gear 15.

In operation, the cleaning apparatus 1 is shown in the "run" position in FIG. 1 with the opening 21 in a generally downward direction and the stripping skive out of engagement with the brush 2. The operator notices poor cleaning or is so signaled by logic of a copier, printer or the like in which the cleaning apparatus is installed. The operator rotates knob 13 clockwise by hand until it reaches the "service" position, as shown in FIG. 2 and as indicated by the knob, thus rotating the container receiving means 11 from its second position to its first position. This rotation of knob 13 also rotates cam 14 and gear 15. Rotation of cam 14 moves stripping skive 17 into stripping engagement with brush 2 through lever 16. Rotation of gear 15 brings the toothed portion into driven engagement with drive gear 18.

With the container receiving means 11 in its first position, tab 22 is not prevented by detent 12 from movement parallel to the axis of the container 20. An empty container can now be removed and a full one inserted.

After insertion of a container containing fresh cleaning material, the apparatus is turned on or cycled causing the brush 2 and detoning roller 4 to rotate. Rotation of detoning roller 4 causes drive gear 18 to rotate rotating driven gear 15 until the container receiving means 11 reaches its second position and the knob reaches its "run" position, as shown in FIG. 1. This rotation rotates cam 14 to eventually remove stripping skive 17 from the moving brush 2 but only after the used particulate material has been stripped and fallen onto auger 6 for removal. This rotation stops when driven gear 15 has no teeth in engagement with drive gear 18, as shown in FIG. 1. As is well known int he art, separate augers may be provided for toner and cleaning material to permit separate disposal, for example, to reuse the toner.

When the container receiving means reaches its second position, particulate material is free to move through opening 21 and passageway 19 under force of gravity and onto moving bare brush 2. The movement of brush 2 and the restriction of passageway 19 meter the particulate material onto the brush.

In the "run" position, the container 20 cannot be removed because of detent 12 and tab 22. A new container can only be inserted in an operation which also cleans off the old particulate material, thereby assuring that the brush will never be overloaded and damaged or rendered less efficient because of too much cleaning material.

Opening 21 in container 20 can be closed for storage by a tape that is removable by the operator either before insertion into the container receiving means 11 or, with the aid of an elongated tab end, removed after insertion. Alternatively, the container can have a permanent mechanical closure that is automatically slid into an opening position by rotation of the container receiving means 11 or by sliding of the container into the container receiving means 11 in the loading operation.

This invention has been described in detail with particular reference to preferred embodiments thereof, but it will be understood that variations and modifications can be effected within the spirit and scope of the invention.

We claim:

1. Magnetic brush cleaning apparatus for cleaning toner off a moving surface, said apparatus being of the type including magnetic brush means for transporting magnetic particulate cleaning material through an endless path, which path includes cleaning relationship with said moving surface;

characterized by a particulate cleaning material replacement device including:

means for receiving a container containing particulate cleaning material and havng an opening, said means being rotatable between a first position in which said container opening is generally up and a second position in which said opening is in gravitational metering relation with said magnetic brush means; and means for rotating said container receiving means from said first to said second positions in response to operation of said apparatus.

2. Apparatus according to claim 1 further characterized by a skive movable into particulate cleaning material stripping relation with said magnetic brush means to clean particulate cleaning material off said brush, and means for moving said skive into cleaning relation with said magnetic brush means in response to movement of said container receiving means to its first position.

3. Apparatus according to claim 2 characterized in that said means for moving said skive includes a cam rotatable with said container receiving means.

4. Apparatus according to claim 3 characterized in that said cam also includes means for removing said skive from stripping relation with the brush means in response to rotation of said container receiving means from said first position to said second position.

5. Apparatus according to claim 2 characterized in that said container receiving means is rotatable from said second position to said first position by hand.

6. Apparatus according to claim 1 characterized by detoning means movable through an endless path, which path includes detoning relation with said particulate material being moved by said magnetic brush means, and drive means responsive to movement of said detoning means for rotating said container receiving means from its first to its second positions.

7. Apparatus according to claim 6 characterized in that said drive means includes a drive gear rotatable with said detoning means and a driven gear rotatable with said container receiving means.

8. Apparatus according to claim 7 characterized in that said driven gear includes teeth around only a portion of its periphery, the portion not including teeth permitting rotation of said container receiving means from said second position to said first position by hand.

9. Apparatus according to claim 6 characterized in that said magnetic brush means and said detoning means are rollers.

10. Apparatus according to claim 1 characterized in that said container receiving means is rotatable from said second position to said first position by hand.

11. Apparatus according to claim 1 further characterized in that said container receiving means includes detent means positiioned to prevent receipt of a container except when said container receiving means is in said first position.

12. A container for use with an apparatus as defined in claim 11 including means for cooperating with said detent to prevent removal of said container except when said container receiving means is in its first position.

13. A container for use with an apparatus of the type described in claim 11 which container is cylindrical in shape, has a longitudinal opening, and includes means for cooperating with a detent on the container receiving means to prevent removal of the container except when the container receiving means is in its first position.

14. Cleaning apparatus for cleaning toner off a moving surface, said apparatus being of the type including brush means for moving particulate cleaning material through an endless path which path includes cleaning relationship with said moving surface;

characterized by a particulate cleaning material replacement device including:

means for receiving a container containing particulate cleaning material and having an opening, said means being rotatable between a first position in which said container opening is generally up and a second position in which said opeing is in metering relation with said brush means; and means for rotating said container receiving means from said first to said second positions in response to operation of said apparatus.

15. Apparatus according to claim 14 further characterized by a passageway which communicates with a received container when said container receiving means is in its second position through which particulate cleaning material can move under influence of gravity as metered by movement of said brush means.

16. Device for replacing particulate cleaning material in a toner cleaning apparatus, said apparatus being of the type having means for transporting particulate material through an endless path between a position in which the particulate material is brought into cleaning relation with a toner bearing moving surface and a position in which the particulate material is brought into toner removing relation wth means for removing toner from the particulate material, said device comprising:

means for receiving a container of particulate cleaning material, said container having an opening above contained material as received by said means; and means for rotating a received container to position the opening below said material and in communication with said transporting means for gravitational metering into operative relation therewith.

17. The device according to claim 16 wherein said means for rotating and said transporting means are actuated in response to cycling of the apparatus to first rotate the container and then, in response to movement of said transporting means, to meter the cleaning material into operative relation with the transporting means.

18. The device according to claim 17 further comprising means for cleaning particulate cleaning material off the transporting means, which means for cleaning is controlled by the rotational location of said means for rotating.

19. Cleaning apparatus for cleaning toner off a moving surface, said apparatus being of the type including brush means for moving particulate cleaning material through an endless path which path includes cleaning relationship with said moving surface;

characterized by a particulate cleaning material replacement device including:

means for receiving a container containing particulate cleaning material;

means for changing said container from a condition permitting replacement of the container to a condition permitting emptying of particulate material from said container to said brush means; and skive strippig means movable into and out of stripping relation with said brush means in response to change of conditions of a received container to automatically remove old particulate material from said brush means when adding new material.

20. A magnetic brush cleaning apparatus for cleaning toner off a movng surface, said apparatus comprising:

magnetic brush means for moving magnetic particulate cleaning material through an endless path, which path includes cleaning relationship with said moving surface;

a detoning roller rotatable into detoning relation with said particulate material;

means for cleaning toner off said detoning roller;

sump means for receiving toner cleaned off said detoning roller;

a skive movable into cleaning relation with said magnetic brush means to clean particulate cleaning material off said brush and into said sump means;

a particulate cleaning material replacement device including:

means for receiving a container having an opening, said means being rotatable between first and second positions in which said container opening is generally up and generally down, respectively, said means being rotatable from its second to its first positon by hand;

means associated with said detoning roller for rotating said container receiving means from said first to said second positions in response to rotation of said detoning roller; and means for moving said skive into cleaning relation with said magnetic brush means in response to movement of said container receiving means to its first position.

* * * * *